US012246207B1

(12) United States Patent
Yu

(10) Patent No.: US 12,246,207 B1
(45) Date of Patent: Mar. 11, 2025

(54) DUMBBELL WITH MULTIPLE GEARS OF WEIGHT ADJUSTMENT AND DUMBBELL KIT

(71) Applicant: Zhejiang Zuojian Industry and Trade Co., Ltd., Jinhua (CN)

(72) Inventor: Zhaohong Yu, Yongkang (CN)

(73) Assignee: Zhejiang Zuojian Industry and Trade Co., Ltd., Jinhua (CN)

( * ) Notice: Subject to any disclaimer, the term of this patent is extended or adjusted under 35 U.S.C. 154(b) by 0 days.

(21) Appl. No.: 18/957,948

(22) Filed: Nov. 25, 2024

(30) Foreign Application Priority Data

Nov. 15, 2024 (CN) ..... 202422787609.X

(51) Int. Cl.
*A63B 21/072* (2006.01)
*A63B 21/075* (2006.01)

(52) U.S. Cl.
CPC ..... *A63B 21/0726* (2013.01); *A63B 21/075* (2013.01)

(58) Field of Classification Search
CPC .. A63B 21/072; A63B 21/0726; A63B 21/075
See application file for complete search history.

(56) References Cited

U.S. PATENT DOCUMENTS

| | | | | |
|---|---|---|---|---|
| 10,518,123 | B2 * | 12/2019 | Moran | A63B 21/0726 |
| 11,167,167 | B1 * | 11/2021 | Weng | A63B 21/0726 |
| 11,471,722 | B2 * | 10/2022 | Lu | A63B 21/075 |
| 11,794,061 | B2 * | 10/2023 | Yao | A63B 21/0728 |
| 11,806,568 | B1 * | 11/2023 | Hong | A63B 21/0726 |
| 11,850,464 | B2 * | 12/2023 | Gottehrer | A63B 21/0728 |
| 2018/0353794 | A1 * | 12/2018 | Wang | A63B 71/0036 |
| 2023/0046695 | A1 * | 2/2023 | Zhou | A63B 21/0726 |
| 2023/0271050 | A1 * | 8/2023 | Tong | A63B 21/0728 482/108 |
| 2023/0347198 | A1 * | 11/2023 | Hong | A63B 21/0728 |
| 2024/0408434 | A1 * | 12/2024 | Liu | A63B 21/0726 |

* cited by examiner

*Primary Examiner* — Joshua Lee
(74) *Attorney, Agent, or Firm* — JEEN IP LAW, LLC

(57) ABSTRACT

A dumbbell with multiple gears of weight adjustment is provided, which includes a dumbbell body, dumbbell pieces provided at two ends of the dumbbell body, and two adjustment mechanisms respectively provided at the two ends of the dumbbell body. The dumbbell body includes a grip rod, a center rod, and two sets of shell components respectively provided on two sides of the grip rod. The center rod is rotatably provided at a center position of the grip rod; each shell component includes a main body shell and a plurality of connection discs. The main body shell is rotatably connected to the grip rod and fixed to the central rod. The connection disks are fixedly provided on the central rod and are distributed along a central length direction. The present application has the effect of improving a weight adjustment efficiency of the dumbbell.

10 Claims, 13 Drawing Sheets

DUMBBELL WITH MULTIPLE GEARS OF WEIGHT ADJUSTMENT AND DUMBBELL KIT

CROSS-REFERENCE TO RELATED APPLICATIONS

This application claims priority to Chinese Patent Application No. 202422787609.X, filed on Nov. 15, 2024, which is hereby incorporated by reference in its entirety.

TECHNICAL FIELD

The present disclosure relates to the field of dumbbell technologies, and in particular, to a dumbbell with multiple gears of weight adjustment and a dumbbell kit.

BACKGROUND

Dumbbells are widely used as fitness equipment, especially those that can easily adjust weight, which are favored by many fitness enthusiasts. A user needs to frequently adjust different weights or number of dumbbell pieces to achieve various weight adjustments.

At present, the commonly used weight adjustment dumbbell consists of a dumbbell rod, a plurality of detachable dumbbell pieces, and two spring clamps (or nuts); when adjusting the weight, the spring clamps at two ends are firstly removed, the dumbbell pieces are then added or removed, and the spring clamps are finally installed.

Regarding the relevant technologies mentioned above, although weight adjustment dumbbells achieve weight adjustment, manually disassembling and adjusting the dumbbell pieces to adjust the weight is laborious and requires manual calculation of the adjusted weight, resulting in low efficiency in adjusting the weight of the dumbbells. It is difficult to adjust the weight of the dumbbells frequently, which affects the exercise effect of using the dumbbells.

SUMMARY

In order to improve the weight adjustment efficiency of dumbbells, the present application provides a dumbbell with multiple gears of weight adjustment and a dumbbell kit.

The present application provides a dumbbell with multiple gears of weight adjustment and a dumbbell kit, which adopts the following technical solution.

A dumbbell with multiple gears of weight adjustment, including a dumbbell body, dumbbell pieces provided at two ends of the dumbbell body, and two adjustment mechanisms respectively provided at the two ends of the dumbbell body; the dumbbell body includes a grip rod, a center rod, and two sets of shell components respectively provided on two sides of the grip rod; the center rod is rotatably provided at a center position of the grip rod;

each of the shell components includes a main body shell and a plurality of connection disks; the main body shell is rotatably connected to the grip rod and fixed to the central rod; the plurality of connection disks are fixedly provided on the central rod and uniformly distributed along a central length direction;

each of the two adjustment mechanisms includes an adjustment component, and the adjustment component includes a plurality of adjustment blocks; each dumbbell piece is provided with a first dumbbell hole that penetrates through the dumbbell piece, and each adjustment block respectively passes through and is slidably fitted with the first dumbbell hole; each connection disk is provided with a second dumbbell hole, and each first dumbbell hole is respectively communicated with each second dumbbell hole; when each dumbbell piece is provided on the dumbbell body, each adjustment block passes through the first dumbbell hole and is fixedly clamped to the second dumbbell hole.

By adopting the above technical solution, when the adjustment dumbbell needs to adjust the weight gear, the center rod is fixed and does not rotate, the grip rod is rotated relative to the center rod, so that each adjustment block is slid towards a direction close to each connection disk until each adjustment block passes through and clamped with each second dumbbell hole, one end of the adjustment block passes through the first dumbbell hole and the other end of the adjustment block passes through the second dumbbell hole, each dumbbell piece is respectively fixed to each connection disk; when the dumbbell body is lifted, each connection disk drives each dumbbell piece to follow the dumbbell body to lift, thereby completing the weight gear adjustment of the adjustment dumbbell, rendering the weight gear adjustment of the adjustment dumbbell more simple and convenient. This improves the weight adjustment dumbbell, although it achieves the weight adjustment, but adding or reducing the dumbbell pieces by manually disassembling is laborious and requires manual calculation of the adjusted weight, resulting in low efficiency in adjusting the weight of the dumbbell. It is not easy to adjust the weight of the dumbbell frequently, which affects the exercise effect of using the dumbbell.

In some embodiments of the present disclosure, the adjustment component further includes an adjustment shaft and a plurality of adjustment disks, the adjustment shaft is rotatably provided on the central rod and fixedly connected to the grip rod, the adjustment disks are coaxially and fixedly connected to the adjustment shaft and uniformly distributed along a length direction of the adjustment shaft, each adjustment disk is fixedly provided with a plurality of shift blocks, when each adjustment block passes through the first dumbbell hole and is fixedly clamped to the second dumbbell hole, each adjustment block is respectively abutted against one side of the shift block provided on each adjustment disk that is facing the connection disk.

By adopting the above technical solution, when the adjustment dumbbell is adjusting the weight gear, a rotation of the grip rod drives the adjustment shaft to rotate, and a rotation of the adjustment shaft drives each adjustment disk to rotate simultaneously, so that each shift block of each adjustment disk is rotated along with the rotation of each adjustment disc, until each shift block is rotated to abut against one side of each adjustment block, and each shift block respectively pushes each adjustment block to slide towards a direction close to the connection disc, until each adjustment block respectively abuts against one side of each shift block that is facing the connection disc. At this time, each adjustment block passes through the connection disk to complete the weight adjustment of the adjustment dumbbell, thereby rendering the adjustment dumbbell more user-friendly.

In some embodiments of the present disclosure, the adjustment component further includes a plurality of adjustment springs, each adjustment spring is located between each dumbbell piece and each adjustment block, one end of each adjustment spring is fixedly connected to each adjustment block, and the other end of each adjustment spring is fixedly connected to each dumbbell piece.

In some embodiments of the present disclosure, positions and number of the plurality of shift blocks fixedly provided on each adjustment disk are different, and each shift block is provided with an adjustment hole; when the shift block abuts against the adjustment block, the adjustment block passes through and is clamped to the adjustment hole, a connection between each dumbbell piece and the dumbbell body has various changes in number and distance.

By adopting the above technical solution, the number and position of each shift block on each adjustment disk are different, when the adjustment shaft drives each adjustment disk to rotate simultaneously, pushing situation of each shift block on each adjustment disk to each adjustment block is different. Therefore, by scientifically setting the position of each shift block on each adjustment disk, the number and distance of the dumbbell pieces fixedly connected at the two ends of the dumbbell body are not the same when the grip rod is rotated to different angles. By adjusting the number and distance of the dumbbell pieces fixedly connected to the two ends of the dumbbell body, the multi-gear weight adjustment of the dumbbell body can be achieved, thereby achieving better exercise effects and better usability.

In some embodiments of the present disclosure, the adjustment shaft includes a plurality of shaft body parts, and the plurality of shaft body parts are coaxially fixed with each adjustment disk; an outer circumferential surface on one end of each shaft body part is fixedly provided with a plurality of connection protrusions, and an inner circumferential surface on the other end of each shaft body part is provided with a plurality of connection recesses; when the shaft body parts are connected to each other end by end to form the adjustment shaft, each connection protrusion passes through and is clamped to each connection recess.

In some embodiments of the present disclosure, the adjustment mechanism further includes a shift component, and the shift component includes a shift disk, a plurality of shift balls, and a plurality of shift springs; where the shift disk is fixedly provided on the grip rod, each shift ball is slidably fitted with the main body shell, and the shift balls are uniformly distributed around an axis of the main body shell in a circumferential direction; one end of each shift spring is fixedly connected to the main body shell, and each shift spring is fixedly connected to each shift ball; the shift disk is provided with a plurality of shift holes, and the plurality of shift holes are uniformly distributed around an axis of the shift disk in a circumferential direction, a number of the shift holes is greater than or equal to a number of the shift balls, each of the shift balls passes through and is clamped to each shift hole.

In some embodiments of the present disclosure, the shift disk includes a first shift part and a second shift part, the first shift part is fixedly connected to the second shift part, the first shift part is provided on one side away from the main body shell, and the second shift part is provided on one side close to the main body shell;

the first shift part is provided with a plurality of gear scale marks, and each gear scale mark is respectively arranged to be faced with each shift hole; an outer circumferential surface of the main body shell is fixedly provided with a scale pointer, which points to anyone gear scale mark.

In some embodiments of the present disclosure, the adjustment mechanism further includes a locking component, and the locking component includes a locking block and a locking spring, the locking block is slidably fitted with the main body shell; one end of the locking spring is fixedly connected to the main body shell, and the other end of the locking spring is fixedly connected to the locking block;

an outer circumferential surface of the second shift part is fixedly provided with a plurality of locking protrusions, and the locking protrusions are uniformly distributed around an axis of the second shift part in a circumferential direction; each locking protrusion is respectively arranged to be faced with each shift hole, and a locking groove is formed between adjacent two locking protrusions; when the locking component is locked, the locking block passes through and is clamped to anyone locking groove;

an outer circumferential surface of the first shift part is fixedly provided with a plurality of protective protrusions, and the protective protrusions are uniformly distributed around an axis of the first shift part in a circumferential direction; a protective groove is formed between adjacent two protective protrusions, and the protective groove is respectively communicated with each locking groove; the main body shell is provided with an unlocking groove that runs through the main body shell, and the unlocking groove is communicated with to anyone locking groove.

A dumbbell kit dumbbell kit, including the weight adjustment dumbbell and a dumbbell seat configured for placing the weight adjustment dumbbell, where the dumbbell seat is provided with a placement groove, and the placement groove is provided with two unlocking protrusions configured for unlocking the locking component; when the weight adjustment dumbbell is placed on the dumbbell seat, the two unlocking protrusions respectively pass through the two unlocking grooves and push the locking block to be detached from a clamp connection with the locking groove.

In some embodiments of the present disclosure, a protective block is fixedly provided on one side of the unlocking protrusion, when the unlocking protrusion abuts against the locking block, the protective block is located between the first shift part and the second shift part, and the weight adjustment dumbbell is shifted; when the locking component is relocked, the protective block is exited from anyone protective groove to disengage from the weight adjustment dumbbell, the dumbbell seat is disengaged from the dumbbell, and the weight adjustment dumbbell is shifted; when the locking component is not fully relocked, the protective block abuts against anyone protective protrusion, and the dumbbell seat is not easily detached from the weight adjustment dumbbell.

In summary, the present application includes at least one beneficial technical effect as follows.

When the adjustment dumbbell needs to adjust the weight gear, the center rod is fixed and does not rotate, the grip rod is rotated relative to the center rod, so that each adjustment block is slid towards a direction close to each connection disk until each adjustment block passes through and clamped with each second dumbbell hole, one end of the adjustment block passes through the first dumbbell hole and the other end of the adjustment block passes through the second dumbbell hole, each dumbbell piece is respectively fixed to each connection disk; when the dumbbell body is lifted, each connection disk drives each dumbbell piece to follow the dumbbell body to lift, thereby completing the weight gear adjustment of the adjustment dumbbell, rendering the weight gear adjustment of the adjustment dumbbell more simple and convenient. This improves the weight adjustment dumbbell, although it achieves the weight adjustment, but adding or reducing the dumbbell pieces by manually disassembling is laborious and requires manual calculation of the adjusted weight, resulting in low efficiency in adjusting the weight of the dumbbell. It is not easy to adjust the weight of the dumbbell frequently, which affects the exercise effect of using the dumbbell.

NUMERAL REFERENCE

1—dumbbell body; 11—grip rod; 12—central rod; 13—shell component; 131—main body shell; 1311—scale pointer; 1312—unlocking groove; 132—connection disk; 1321—second dumbbell hole; 1322—adjustment slot; 133—fixed disk; 134—fixed rod; 135—fixed shell; 2—dumbbell piece; 21—first dumbbell hole; 3—adjustment mechanism; 31—shift component; 311—shift disk; 3111—first shift part; 31111—gear scale mark; 31112—protective protrusion; 31113—protective groove; 3112—second shift part; 31121—shift hole; 31122—locking protrusion; 31123—locking groove; 312—shift shaft; 313—shift ball; 314—shift spring; 32—locking component; 321—locking block; 322—locking spring; 33—adjustment component; 331—adjustment block; 3311—first adjustment part; 3312—second adjustment part; 332—adjustment spring; 333—adjustment shaft; 3331—shaft body part; 33311—connection protrusion; 33312—connection recess; 334—adjustment disk; 3341—shift block; 33411—adjustment hole; 40—weight adjustment dumbbell; 50—dumbbell seat; 501—placement groove; 502—unlocking protrusion; 503—protective block.

DESCRIPTION OF EMBODIMENTS

Further, a detailed explanation of the present application will be provided in combination with FIGS. 1-13.

Figure 1:
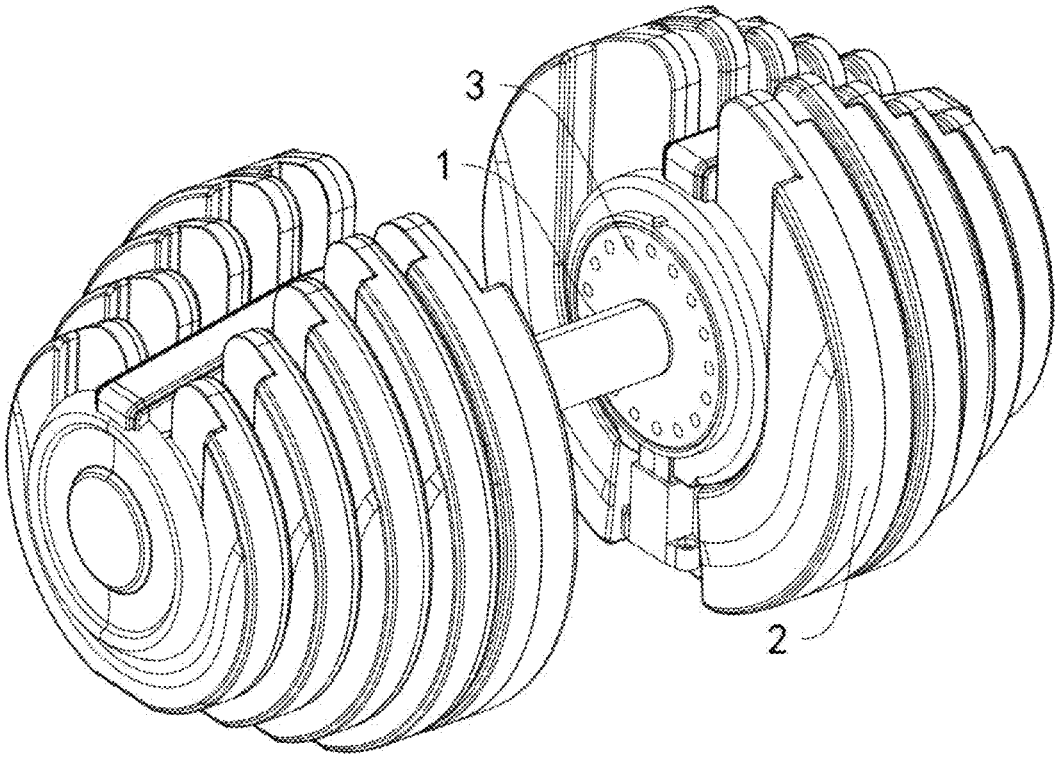
FIG. 1 is a schematic diagram of an overall structure of an embodiment of the present application.
Figure 2:
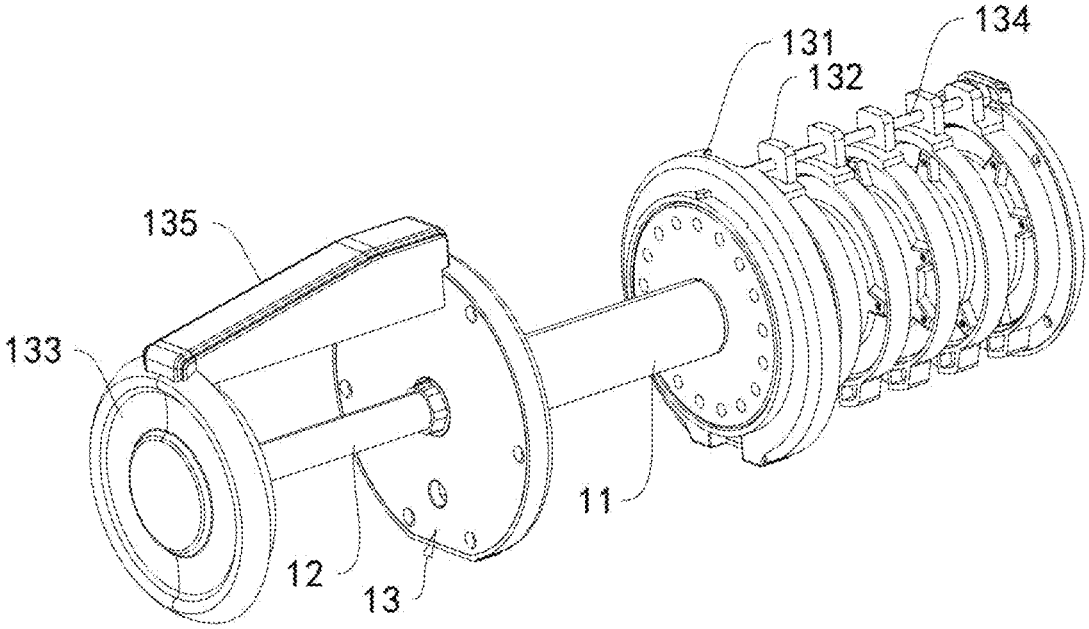
FIG. 2 is a schematic structural diagram of a dumbbell body in an embodiment of the present application.

An embodiment discloses a dumbbell with multiple gears of weight adjustment and a dumbbell kit. Referring to FIGS. 1 and 2, the dumbbell with multiple gears of weight adjustment includes a dumbbell body 1, dumbbell pieces 2 cumulatively provided at two ends of the dumbbell body 1, and two adjustment mechanisms 3 respectively provided at the two ends of the dumbbell body 1. The dumbbell body 1 includes a grip rod 11, a center rod 12, and two sets of shell components 13 respectively provided on two sides of the grip rod 11. The grip rod 11 is a cylindrical shape with a hollow center, and the center rod 12 is provided at a center position of the grip rod 11 and is rotatably connected to the grip rod 11.

Referring to FIGS. 1 and 2, each of the shell components 13 includes a main body shell 131, a plurality of connection disks 132, a fixed disk 133, a fixed rod 134, and a fixed shell 135. The main body shell 131 is rotatably connected to the grip rod 11, and the connection disks 132 are coaxially and rotatably provided on the grip rod 11 and uniformly distributed along a length direction of the central rod 12. The fixed disk 133 is coaxially and fixedly provided at one end of the central rod 12 away from the grip rod 11, and the fixed rod 134 is located between the fixed disk 133 and the main body shell 131. One end of the fixed rod 134 is threaded to the fixed disk 133, and the other end of the fixed disk 133 is threaded to the main body shell 131, thereby fixing the main body shell 131 and the central rod 12. The fixed rod 134 passes through each connection disk 132 and is fixedly connected to each connection disk 132. Thus, each connection disk 132 is fixed to the central rod 12, and the fixed shell 135 is located between the fixed disk 133 and the main body shell 131. One end of the fixed shell 135 is fixedly connected to the main body shell 131, and the other end of the fixed shell 135 is fixedly connected to the fixed disk 133. The fixed shell 135 covers and protects the fixed rod 134.

Figure 3:
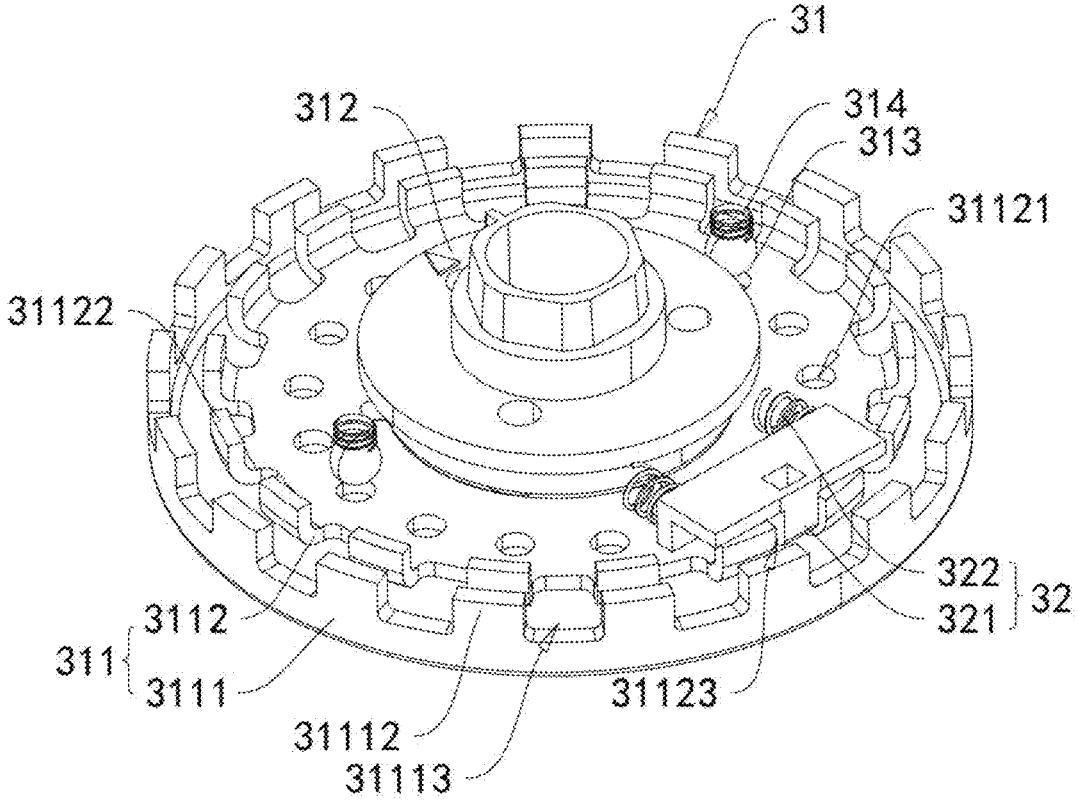
FIG. 3 is a schematic structural diagram of a shift component in an embodiment of the present application.
Figure 4:
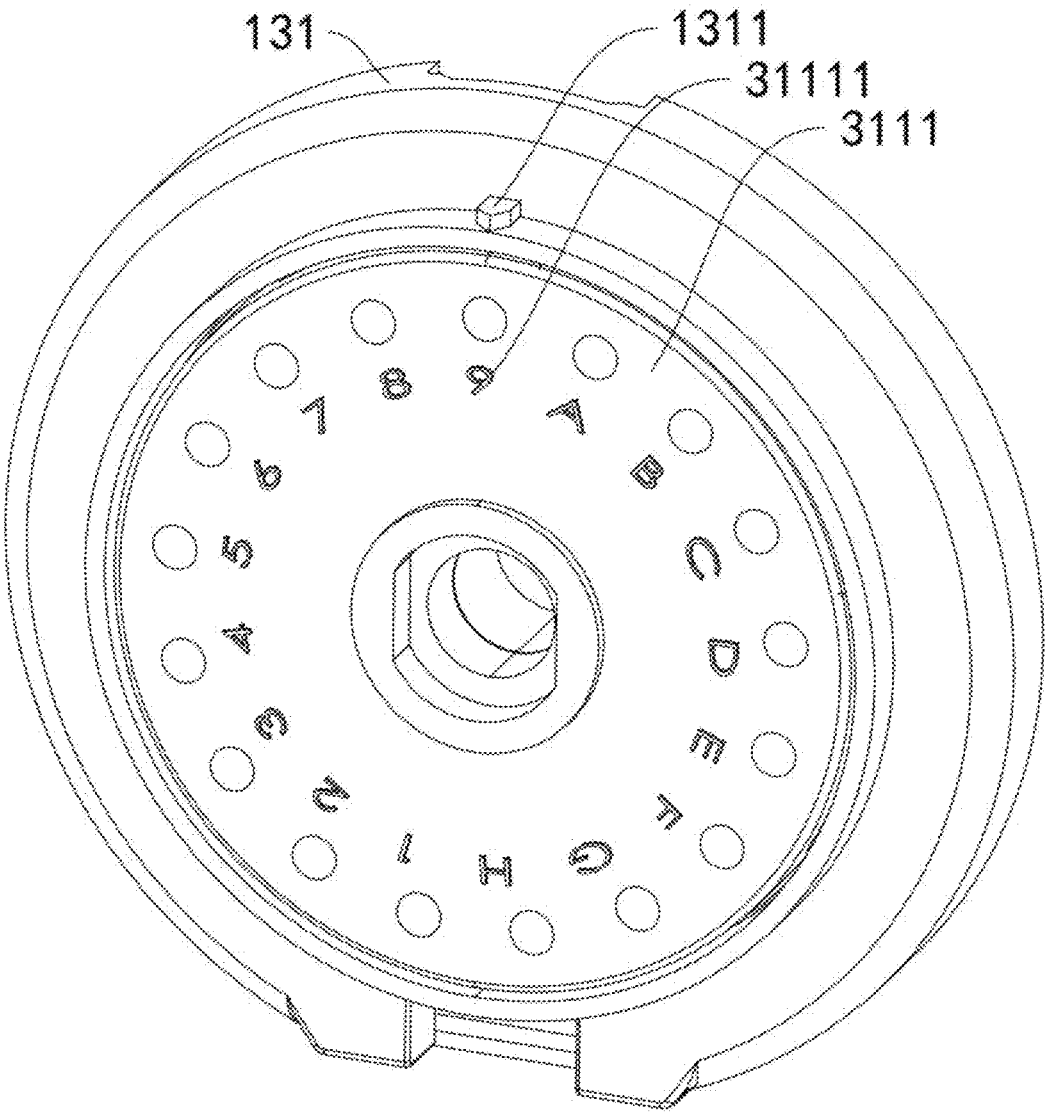
FIG. 4 is a schematic structural diagram of a first shift part in an embodiment of the present application.

Referring to FIGS. 3 and 4, the adjustment mechanism 3 includes a shift component 31, and the shift component 31 includes a shift disk 311 and a shift shaft 312. The shift disk 311 includes a first shift part 3111 and a second shift part 3112. The first shift part 3111 is provided on one side away from the main body shell 131, and the second shift part 3112 is provided on one side close to the main body shell 131. The first shift part 3111 is fixedly connected to one end of the grip rod 11, and the second shift part 3112 is fixedly connected to one side of the first shift part 3111 away from the grip rod 11. The shift shaft 312 is rotatably provided on the main body shell 131. One end of the shift shaft 312 close to the shift disk 311 is fixedly connected to the shift disk 311, so that the grip rod 11 is caused to rotate, and the shift disk 311 is rotated and drives the shift shaft 312 to rotate.

Referring to FIGS. 3 and 4, the first shift part 3111 is engraved with a plurality of gear scale marks 31111, each gear scale mark 31111 is arranged to be faced with each shift hole 31121, and a scale pointer 1311 is fixedly provided on an outer circumference of the main body shell 131. The scale pointer 1311 points to anyone gear scale mark 31111, and the gear scale mark 31111 pointed by the scale pointer 1311 indicates a gear position of adjusting the dumbbell at this time.

Referring to FIGS. 3 and 4, the shift component 31 further includes two shift balls 313 and two shift springs 314. The two shift balls 313 are both slidably fitted with the main body shell 131, and the two shift balls 313 are uniformly distributed around an axis of the main body shell 131 in a circumferential direction. One ends of the two shift springs 314 are fixedly connected to the main body shell 131, and the two shift springs 314 are respectively fixedly connected to the two shift balls 313. The second shift part 3112 is provided with a plurality of shift holes 31121 that are penetrated. The shift holes 31121 are uniformly distributed around an axis of the shift disk 311 in a circumferential direction, and each shift hole 31121 corresponds to each gear scale mark 31111. After a gear adjustment of the adjustment dumbbell is completed, the two shift balls 313 respectively pass through and clamped with two corresponding shift holes 31121.

Figure 5:
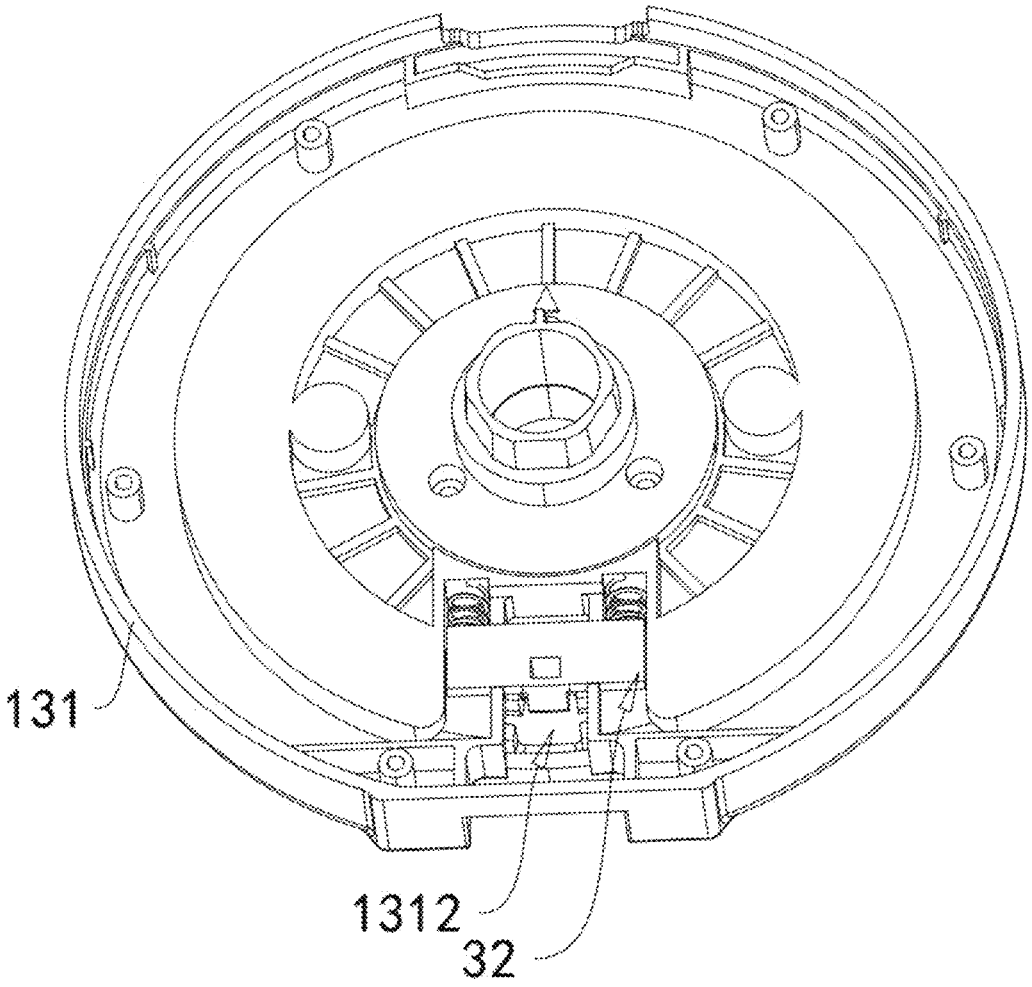
FIG. 5 is a schematic diagram of a main body shell of an embodiment of the present application.

Referring to FIGS. 3 and 5, the adjustment mechanism 3 further includes a locking component 32, the locking component 32 includes a locking block 321 and two locking springs 322. The locking block 321 is slidably fitted with the main body shell 131 along a radial direction, and the two locking springs 322 are located between the locking block 321 and the main body shell 131. One ends of the two locking springs 322 are fixedly connected to the main body shell 131, and the other ends of the two locking springs 322 are fixedly connected to the locking block 321.

Referring to FIGS. 3 and 5, a plurality of locking protrusions 31122 are fixedly provided on an outer circumference surface of the second shift part 3112. The locking protrusions 31122 are uniformly distributed around an axis of the second shift part 3112 in a circumferential direction. Each locking protrusion 31122 is arranged to be faced with each shift hole 31121, and a locking groove 31123 is formed between adjacent locking protrusions 31122. When the locking component 32 is locked, the locking block 321 passes through and clamped with anyone locking groove 31123. When the locking component 32 is unlocked, the locking block 321 is slid away from the locking groove 31123 and disengaged from a clamp connection with the locking groove 31123.

Referring to FIGS. 3 and 5, an outer circumferential surface of the first shift part 3111 is fixedly provided with a plurality of protective protrusions 31112, the plurality of protective protrusions 31112 are uniformly distributed around an axis of the first shift part 3111 in a circumferential direction. A protective groove 31113 is formed between adjacent two protective protrusions 31112, and each protective groove 31113 is communicated with each locking groove 31123. The main body shell 131 is provided with an unlocking groove 1312 that is penetrated, the unlocking groove 1312 is communicated with anyone locking groove 31123.

Figure 6:
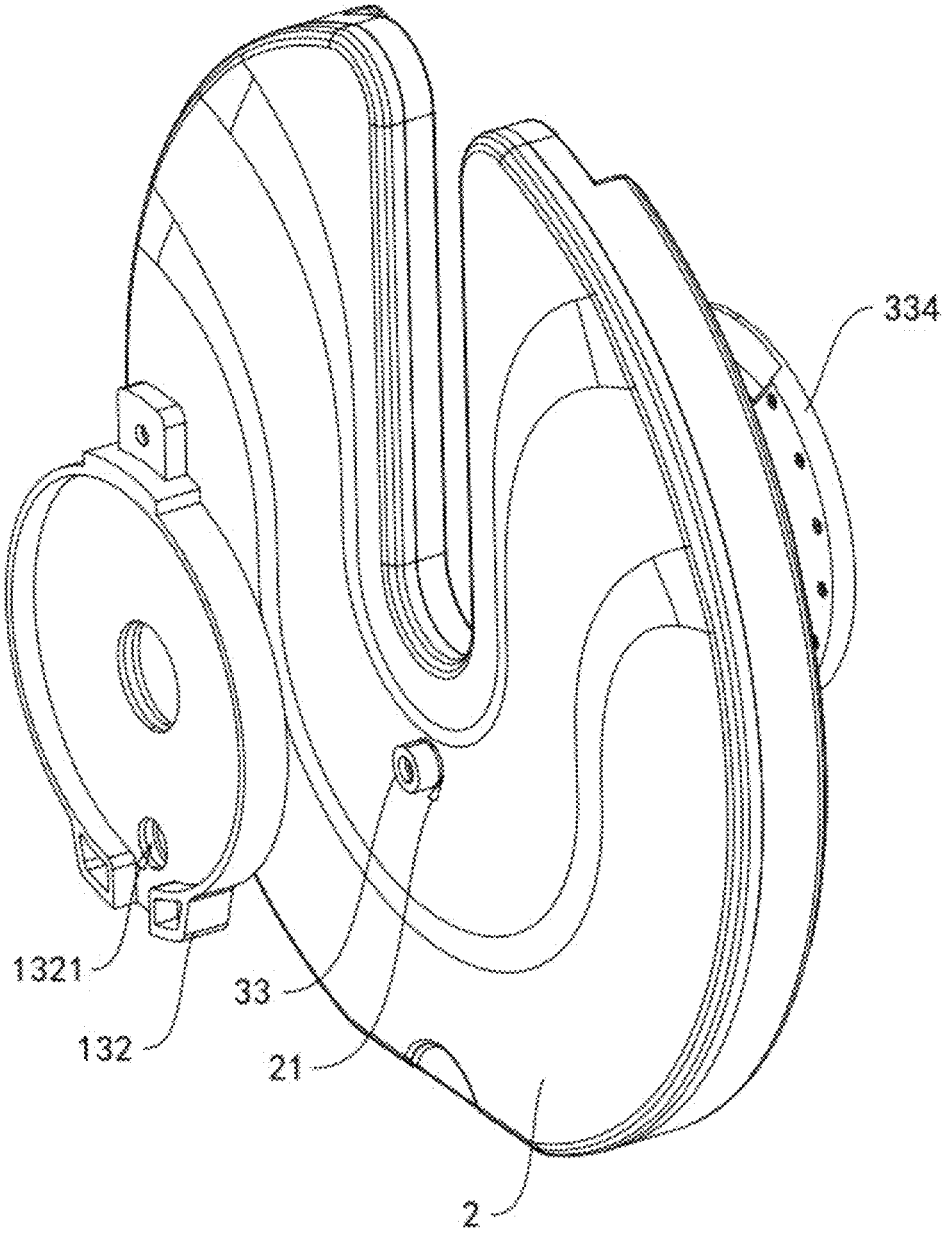
FIG. 6 is an exploded diagram of a connection of an adjustment component in an embodiment of the present application.
Figure 7:
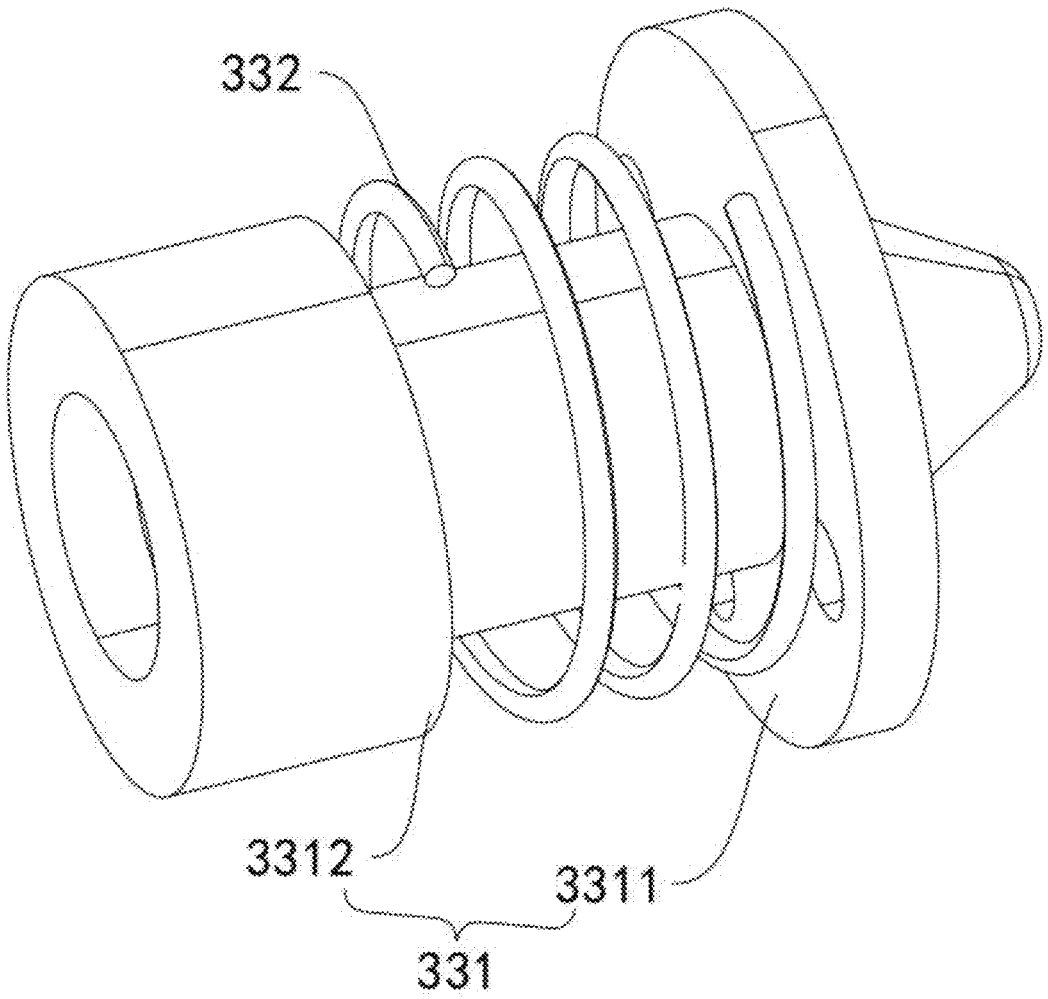
FIG. 7 is a first schematic structural diagram of the adjustment component in an embodiment of the present application.

Referring to FIGS. 6 and 7, the adjustment mechanism 3 includes an adjustment component 33, and the adjustment component 33 includes a plurality of adjustment blocks 331. Each dumbbell piece 2 is provided with a first dumbbell hole 21 that is penetrated, and each connection disk 132 is provided with a second dumbbell hole 1321. Each first dumbbell hole 21 is communicated with each second dumbbell hole 1321, and each adjustment block 331 passes through and is slidably fitted with each first dumbbell hole 21. Each adjustment block 331 includes a first adjustment part 3311 and a second adjustment part 3312. The first adjustment part 3311 and the second adjustment part 3312 are fixedly connected by screws. When each dumbbell piece 2 is provided at two ends of the dumbbell body 1, the first adjustment part 3311 is slid towards a direction close to each dumbbell piece 2, so that each second adjustment part 3312 is slid towards a direction close to each connection disk 132, until each second adjustment part 3312 respectively passes through and clamped into each second dumbbell hole 1321. Thus, each dumbbell piece 2 is fixedly connected to each connection disk 132.

Referring to FIGS. 6 and 7, the adjustment component 33 further includes a plurality of adjustment springs 332, each adjustment spring **332*h* is located between each dumbbell piece 2 and each adjustment block 331. One end of each adjustment spring 332 is fixedly connected to each adjustment block 331, and the other end of each adjustment spring 332 is fixedly connected to each dumbbell piece 2. Therefore, when each adjustment block 331 is needed to be disengaged from each connection disk 132, each adjustment spring 332 pushes each first adjustment part 3311 to slide in a direction close to each dumbbell piece 2, so that each second adjustment part 3312 is slid in a direction away from each connection disk 132, until each second adjustment part 3312 is disengaged from each second dumbbell hole 1321, thus completing an installation detachment of each dumbbell piece 2 with the dumbbell body 1**.

Figure 8:
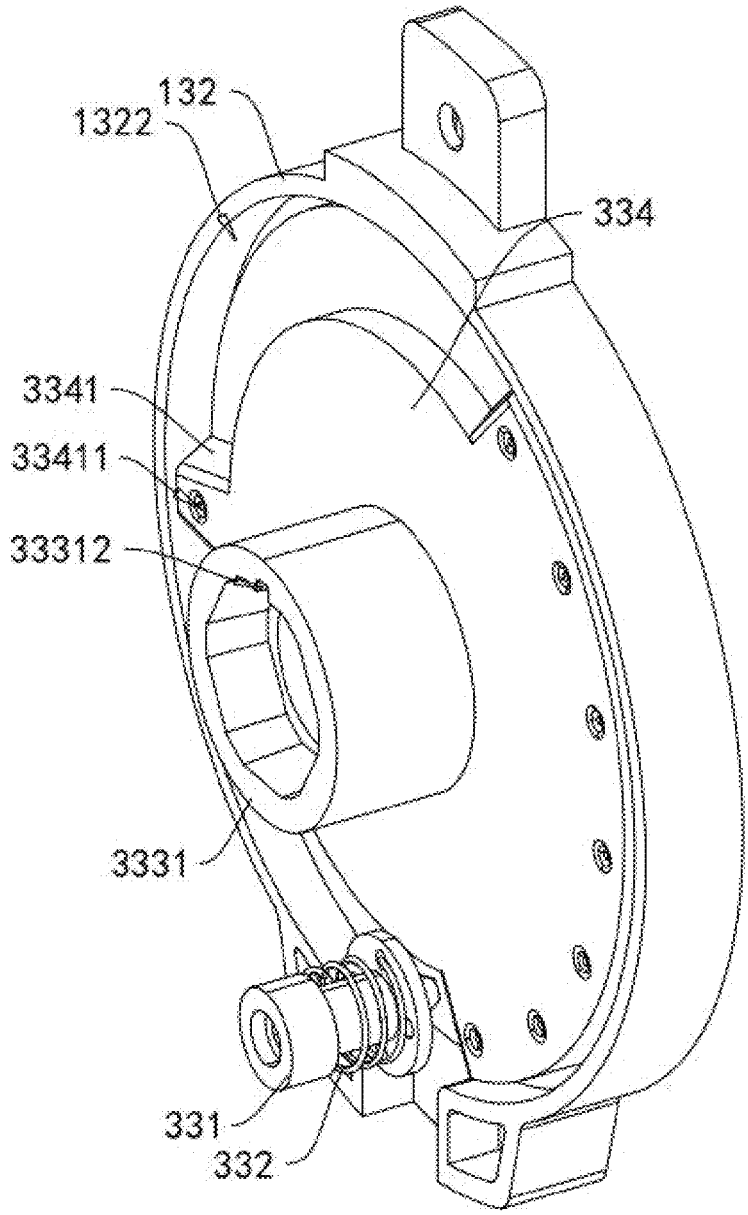
FIG. 8 is a second schematic structural diagram of the adjustment component in an embodiment of the present application.
Figure 9:
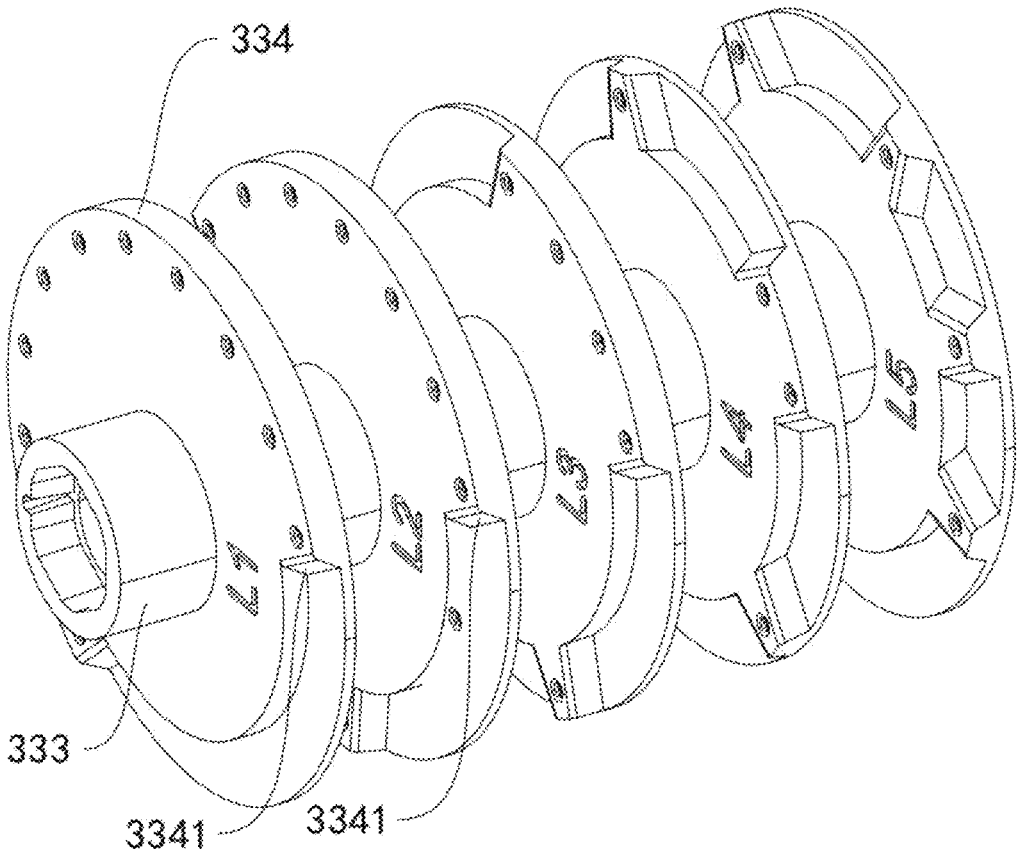
FIG. 9 is a schematic structural diagram of an adjustment disk in an embodiment of the present application.
Figure 10:
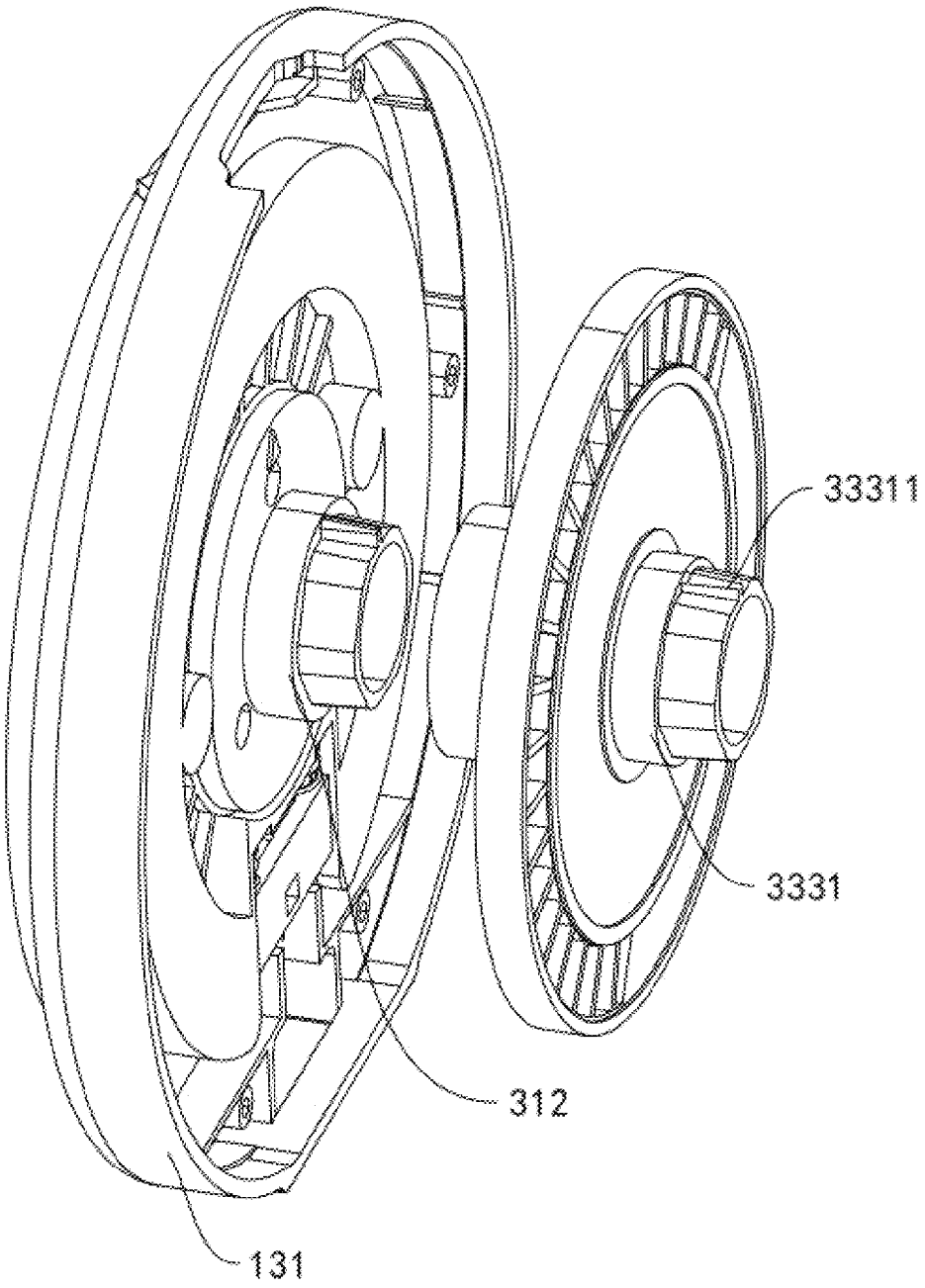
FIG. 10 is a schematic diagram of a connection between an adjustment shaft and a shift shaft in an embodiment of the present application.

Referring to FIGS. 8, 9, and 10, the adjustment component 33 includes an adjusting shaft 333 and a plurality of adjustment disks 334. The adjustment shaft 333 is in a shape of a hollow cylinder, and is coaxially and rotatably provided on the central rod 12 and fixedly clamp with the shift shaft 312. The adjustment shaft 333 includes a plurality of shaft body parts 3331, an outer circumferential surface on one end of each of shaft body part 3331 is fixedly provide with a plurality of connection protrusions 33311, and an inner circumferential surface on the other end of each shaft body part 3331 is provided with a plurality of connection recesses. When the shaft body parts 3331 are connected to each other end by end to form the adjustment shaft 333, each connection protrusion 33311 respectively passes through and clamped to each connection recess 33312, and the adjusting disks 334 are coaxially and fixedly connected to each shaft body part 3331 and uniformly distributed along a length direction of the adjustment shaft 333; one side of each connection disk 132 provided with the grip rod 11 is provide with an adjustment slot 1322. Each adjustment disk 334 respectively passes through and is rotatably fitted with each adjustment slot 1322; when the adjustment shaft 333 is rotated, each adjustment disk 334 is synchronously rotated with the adjustment shaft 333. The adjustment shaft 333 is composed of a plurality of shaft body parts 3331. Thus, each adjustment disk 334 is easy to install and pass through each adjustment slot 1322.

Referring to FIGS. 8, 9 and 10, each adjustment disk 334 is fixedly provided with a plurality of shift blocks 3341. One side of each shift block 3341 opposite to the dumbbell piece 2 is provided with an adjustment hole 33411. One side of each shift block 3341 is inclined from close to the shift block 3341 to close to the adjustment disk 334 from top to bottom. The first adjustment part 3311 is a conical type with gradually decreasing diameter from close to the second adjustment part 3312 to far from the second adjustment part 3312. When the adjustment disk 334 is rotated, the adjustment disk 334 drives the shift block 3341 to rotate, so that one side of the shift block 3341 is abutted against the first adjustment part 3311. Then the adjustment disk 3311 4 continues to rotate, and the first adjustment part 3311 is slid along the side of the shift block 3341 towards the direction close to the dumbbell piece 2 until the first adjustment part 3311 passes through and clamped to the adjustment hole 33411. Thus, the corresponding second adjustment part 3312 passes through and clamped with the corresponding dumbbell piece 2, thereby completing one gear weight adjustment of the dumbbell.

Referring to FIGS. 8, 9, and 10, positions and number of the plurality of shift blocks 3341 fixedly provided on each adjustment disk 334 are different. A connection between each dumbbell piece 2 and the dumbbell body 1 has various change in number and distances, so that when the adjustment shaft 333 drives each adjustment disk 334 to rotate simultaneously, pushing situation of each shift block 3341 on each adjustment disk 334 to each adjustment block 331 is different. Therefore, by scientifically setting the positions of each shift block 3341 on each adjustment disk 334, the number and distance of the dumbbell pieces 2 fixedly connected at the two ends of the dumbbell body 1 are not the same when the grip rod 11 is rotated to different angles. At the same time, because the weight of each dumbbell piece 2 fixedly connected to the dumbbell body 1 is different, by adjusting the number and distance of the dumbbell pieces 2 fixedly connected to two ends of the dumbbell body 1, thereby realizing multi-gear weight adjustment of the dumbbell body 1, so that the dumbbell body 1 in this embodiment has 17 different weight adjustment gears, thereby achieving better exercise effects.

The implementation principle of the dumbbell with multi-gear weight adjustment in the embodiment of present application is as follows: when the adjustment dumbbell needs to adjust the weight gear, the central rod 12 is fixed and does not rotate, the grip rod 11 is rotated relative to the central rod 12, so that each adjustment block 331 is slid towards a direction close to each connection disk 132 until each adjustment block 331 passes through and respectively clamped with each second dumbbell hole 1321, one end of the adjustment block 331 passes through the first dumbbell hole 21, and the other end of the adjustment block 331 passes through the second dumbbell hole 1321, each dumbbell piece 2 is respectively fixed to each connection disk 132; when the dumbbell body 1 is lifted, each connection disk 132 drives each dumbbell piece 2 to follow the dumbbell body 1 to lift, thereby completing the weight gear adjustment of the adjustment dumbbell, rendering the weight gear adjustment of the adjustment dumbbell more simple and convenient. This improves the weight adjustment dumbbell, although it achieves the weight adjustment, but adding or reducing the dumbbell pieces by manually disassembling is laborious and requires manual calculation of the adjusted weight, resulting in low efficiency in adjusting the weight of the dumbbell. It is not easy to adjust the weight of the dumbbell frequently, which affects the exercise effect of using the dumbbell.

Figure 11:
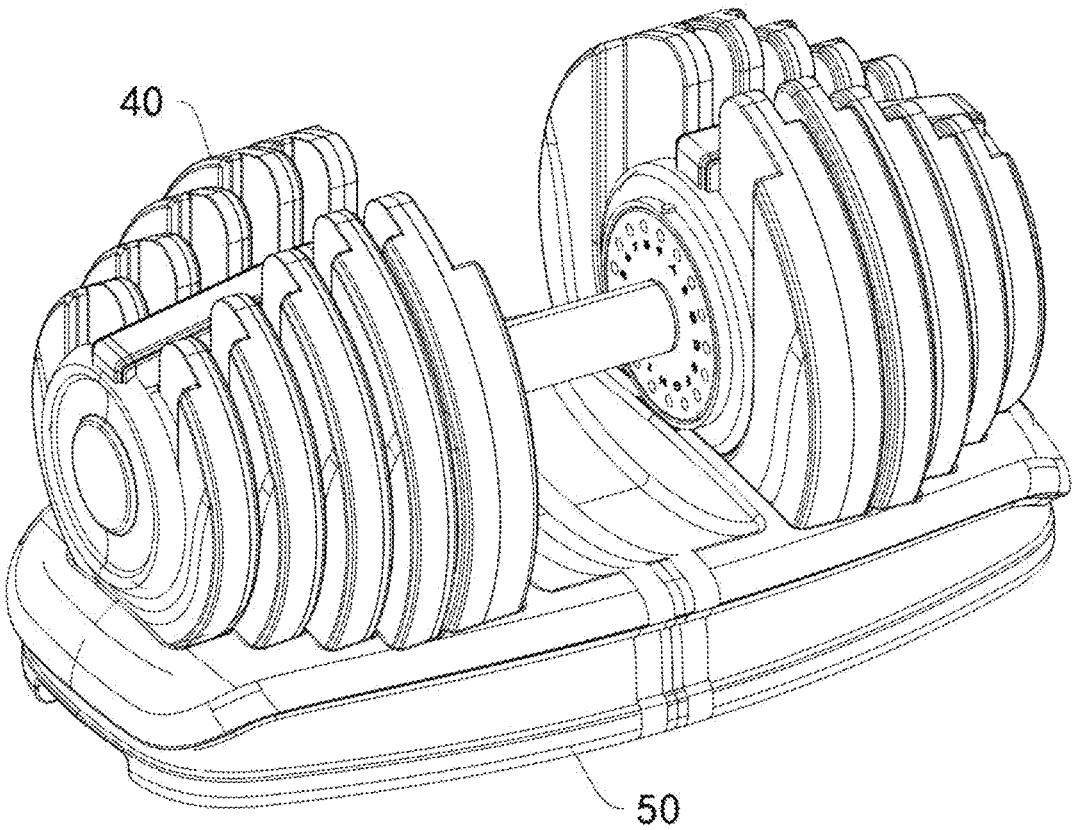
FIG. 11 is a schematic structural diagram of a dumbbell kit according to an embodiment of the present application.
Figure 12:
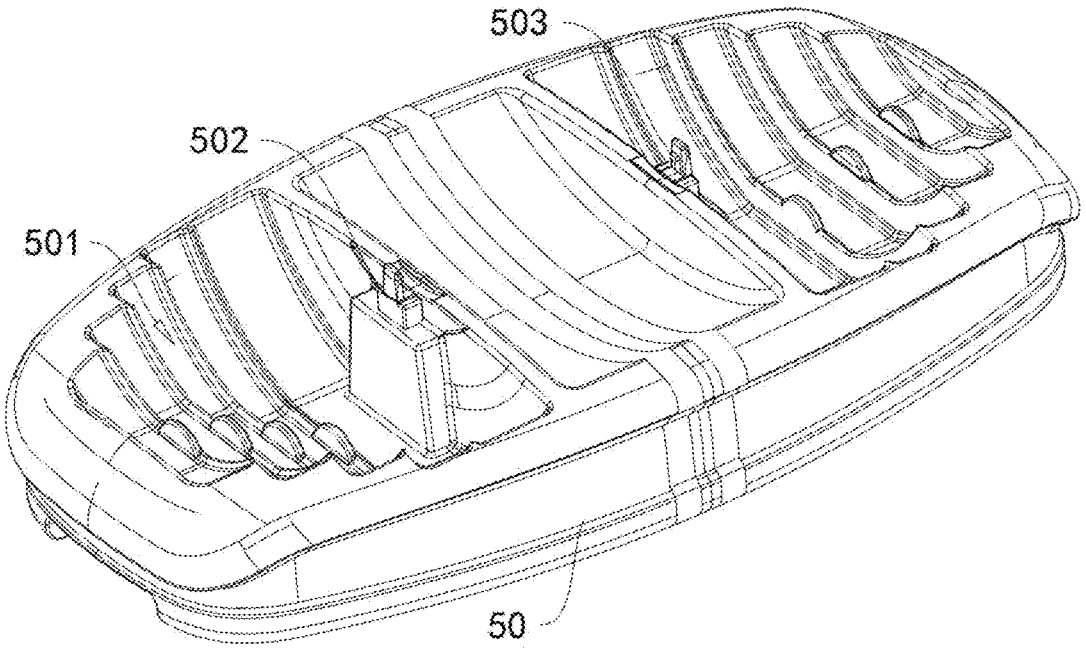
FIG. 12 is a schematic structural diagram of a dumbbell seat in an embodiment of the present application.
Figure 13:
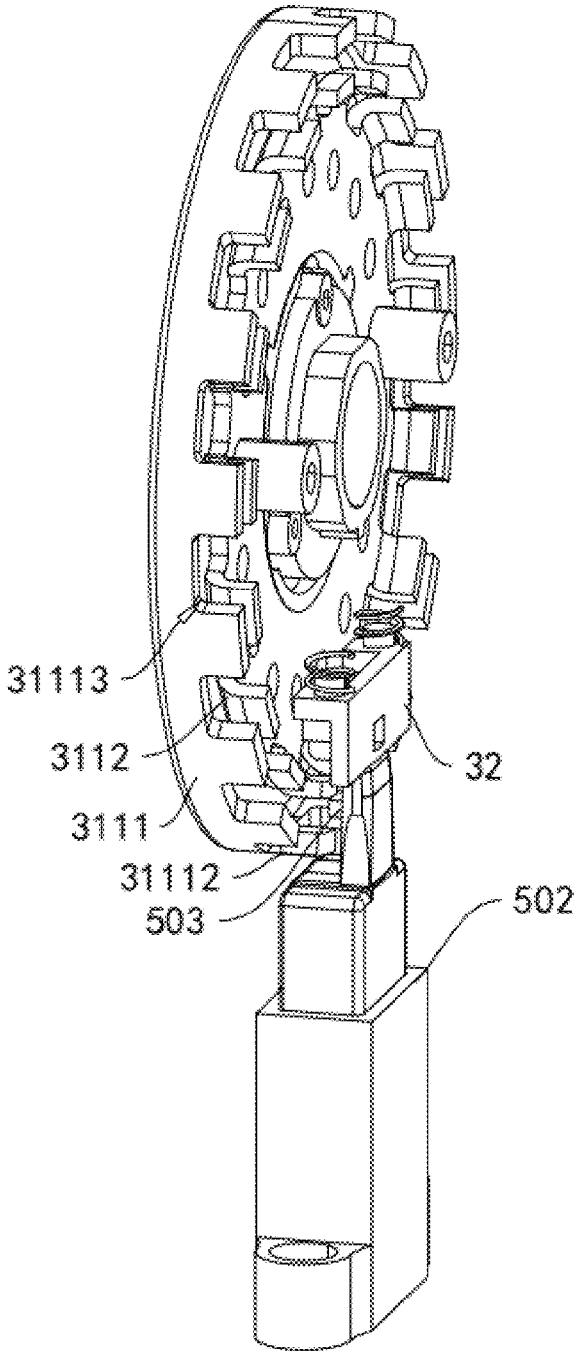
FIG. 13 is a schematic structural diagram of a protection block in an embodiment of the present application.

Referring to FIGS. 11, 12, and 13, it can be seen that when the shift disk needs to be fixed to the main body shell, that is, when the locking component is locked, the locking block needs to be slid in a direction close to the locking groove, passes through and clamped with anyone locking groove. When the shift disk needs to rotate relative to the main body shell for shift, the locking block needs to slide away from the locking groove and disengage from a clamp connection with the locking groove.

Referring to FIGS. 11, 12, and 13, when it is necessary to rotate the grip rod to adjust the number and position of the dumbbell pieces fixedly connected at the two ends of the dumbbell body, the locking block needs to be slid away from the locking groove, that is, the locking block needs to be slid towards an axis direction of the main body shell, so as to disengage from the clamp connection with locking groove.

Referring to FIGS. 11, 12, and 13, this embodiment further provides a dumbbell kit, which includes the adjustment dumbbell 40 and a dumbbell seat 50 configured for placing the adjustment dumbbell 40. The dumbbell seat 50 is provided with a placement groove 501, and the placement groove 501 is provided with two unlocking protrusions 502 for unlocking the locking component 32. When the adjustment dumbbell 40 is placed on the dumbbell seat 50, the two unlocking protrusions 502 respectively passes through the two unlocking grooves 1312 and push the two locking blocks 321 to slide away from the locking groove 31123 until disengaged from the clamp fit with the locking groove 31123, thereby unlocking the locking component 32 and allowing the shift disk 311 to rotate relative to the main body shell 131, enabling the grip rod 11 to be rotated so as to complete the adjustment of number and position of the dumbbell pieces 2 provided on the two sides of the dumbbell body 1. When picking up the adjustment dumbbell 40, due to an elastic force of the locking spring 322, the locking block 321 is slid towards a direction facing the locking groove 31123 and clamped with the with locking groove 31123, thereby re-fixing the grip rod 11 and the main body shell 131, ensuring a structural stability of the adjustment dumbbell 40 during use.

Besides that, a protective block 503 is fixedly provided on one side of the unlocking protrusion 502. When the unlocking protrusion 502 abuts against the locking block 321, the protective block 503 is located between the first shift part 3111 and the second shift part 3112. When the adjustment dumbbell 40 is shifted, and the locking component 32 is re-locked, the protective block 503 is exited from anyone of the protective groove 31113 to disengage from the adjustment dumbbell 40, the dumbbell seat 50 is disengaged from the dumbbell, and the adjustment dumbbell 40 is shifted. When the locking component 32 is not re-locked, the protective block 503 abuts against anyone of the protective protrusions 31112, the dumbbell seat 50 is not easily detached from the adjustment dumbbell 40. Therefore, when the grip rod 11 and the main body shell 131 are not relatively fixed, the adjustment dumbbell 40 is not easily taken from the dumbbell seat 50 for use, thereby ensuring that the use safety of the adjustment dumbbell 40 after being shifted.

The above are the preferred embodiments of the present application and do not limit the protection scope of the present application. Therefore, any equivalent changes made according to the structure, shape, and principle of the present application should be included in the protection scope of the present application.

What is claimed is:

1. A dumbbell with multiple gears of weight adjustment, comprising a dumbbell body, dumbbell pieces provided at two ends of the dumbbell body, and two adjustment mechanisms respectively provided at the two ends of the dumbbell body;

the dumbbell body comprises a grip rod, a center rod, and two sets of shell components respectively provided on two sides of the grip rod;

the center rod is rotatably provided at a center position of the grip rod;

each of the shell components comprises a main body shell and a plurality of connection disks;

the main body shell is rotatably connected to the grip rod and fixed to the center rod;

the plurality of connection disks are fixedly provided on the center rod and uniformly distributed along a central length direction;

each of the two adjustment mechanisms comprises an adjustment component, and the adjustment component comprises a plurality of adjustment blocks;

each dumbbell piece is provided with a first dumbbell hole that penetrates through the dumbbell piece, and each adjustment block respectively passes through and is slidably fitted with the first dumbbell hole;

each connection disk is provided with a second dumbbell hole, and each first dumbbell hole is respectively communicated with each second dumbbell hole;

when each dumbbell piece is provided on the dumbbell body, each adjustment block passes through the first dumbbell hole and is fixedly clamped to the second dumbbell hole.

2. The dumbbell according to claim 1, wherein the adjustment component further comprises an adjustment shaft and a plurality of adjustment disks, the adjustment shaft is rotatably provided on the center rod and fixedly connected to the grip rod, the adjustment disks are coaxially and fixedly connected to the adjustment shaft and uniformly distributed along a length direction of the adjustment shaft, each adjustment disk is fixedly provided with a plurality of shift blocks, when each adjustment block passes through the first dumbbell hole and is fixedly clamped to the second dumbbell hole, each adjustment block is respectively abutted against one side of the shift block provided on each adjustment disk that is facing the connection disk.

3. The dumbbell according to claim 2, wherein the adjustment component further comprises a plurality of adjustment springs, each adjustment spring is located between each dumbbell piece and each adjustment block, one end of each adjustment spring is fixedly connected to each adjustment block, and the other end of each adjustment spring is fixedly connected to each dumbbell piece.

4. The dumbbell according to claim 2, wherein positions and number of the plurality of shift blocks fixedly provided on each adjustment disk are different, and each shift block is provided with an adjustment hole;

when the shift block abuts against the adjustment block, the adjustment block passes through and is clamped to the adjustment hole, a connection between each dumbbell piece and the dumbbell body has various changes in number and distance.

5. The dumbbell according to claim 2, wherein the adjustment shaft comprises a plurality of shaft body parts, and the plurality of shaft body parts are coaxially fixed with each adjustment disk, an outer circumferential surface on one end of each shaft body part is fixedly provided with a plurality of connection protrusions, and an inner circumferential surface on the other end of each shaft body part is provided with a plurality of connection recesses;

when the shaft body parts are connected to each other end by end to form the adjustment shaft, each connection protrusion passes through and is clamped to each connection recess.

6. The dumbbell according to claim 1, wherein the adjustment mechanism further comprises a shift component, and the shift component comprises a shift disk, a plurality of shift balls, and a plurality of shift springs;

wherein the shift disk is fixedly provided on the grip rod, each shift ball is slidably fitted with the main body shell, and the shift balls are uniformly distributed around an axis of the main body shell in a circumferential direction;

one end of each shift spring is fixedly connected to the main body shell, and each shift spring is fixedly connected to each shift ball;

the shift disk is provided with a plurality of shift holes, and the plurality of shift holes are uniformly distributed around an axis of the shift disk in a circumferential direction, a number of the shift holes is greater than or equal to a number of the shift balls, each of the shift balls passes through and is clamped to each shift hole.

7. The dumbbell according to claim 6, wherein the shift disk comprises a first shift part and a second shift part, the first shift part is fixedly connected to the second shift part, the first shift part is provided on one side away from the main body shell, and the second shift part is provided on one side close to the main body shell;

the first shift part is provided with a plurality of gear scale marks, and each gear scale mark is respectively arranged to be faced with each shift hole;

an outer circumferential surface of the main body shell is fixedly provided with a scale pointer, which points to any one of the plurality of gear scale marks.

8. The dumbbell according to claim 7, wherein the adjustment mechanism further comprises a locking component, and the locking component comprises a locking block and a locking spring, the locking block is slidably fitted with the main body shell;

one end of the locking spring is fixedly connected to the main body shell, and the other end of the locking spring is fixedly connected to the locking block;

an outer circumferential surface of the second shift part is fixedly provided with a plurality of locking protrusions, and the locking protrusions are uniformly distributed around an axis of the second shift part in a circumferential direction;

each locking protrusion is respectively arranged to be faced with each shift hole, and a locking groove is formed between adjacent two locking protrusions;

when the locking component is locked, the locking block passes through and is clamped to a corresponding locking groove;

an outer circumferential surface of the first shift part is fixedly provided with a plurality of protective protrusions, and the protective protrusions are uniformly distributed around an axis of the first shift part in a circumferential direction;

a protective groove is formed between adjacent two protective protrusions, and the protective groove is respectively communicated with each locking groove;

the main body shell is provided with an unlocking groove that runs through the main body shell, and the unlocking groove is communicated with to with a corresponding locking groove.

9. A dumbbell kit, comprising a weight adjustment dumbbell and a dumbbell seat configured for placing the weight adjustment dumbbell, wherein the weight adjustment dumbbell is the dumbbell according to claim 1, wherein the dumbbell seat is provided with a placement groove, and the placement groove is provided with two unlocking protrusions configured for unlocking a locking component;

when the weight adjustment dumbbell is placed on the dumbbell seat, two unlocking protrusions respectively pass through two unlocking grooves and push a locking block to be detached from a clamp connection with a locking groove.

10. The dumbbell kit according to claim 9, wherein a protective block is fixedly provided on one side of each unlocking protrusion, when each unlocking protrusion abuts against the locking block, the protective block is located between a first shift part and a second shift part, and the weight adjustment dumbbell is shifted;

when the locking component is relocked, the protective block is exited from a corresponding protective groove to disengage from the weight adjustment dumbbell, the dumbbell seat is disengaged from the weight adjustment dumbbell, and the weight adjustment dumbbell is shifted;

when the locking component is not fully relocked, the protective block abuts against a corresponding protective protrusion, and the dumbbell seat is not easily detached from the weight adjustment dumbbell.

* * * * *